US007627915B2

(12) United States Patent
Eriksson

(10) Patent No.: US 7,627,915 B2
(45) Date of Patent: Dec. 8, 2009

(54) MOBILE STRETCHER

(75) Inventor: Jan Eriksson, Skellefteå (SE)

(73) Assignee: Mobile Intensive Care Unit Sweden Micus AB, Skelleftea (SE)

( * ) Notice: Subject to any disclaimer, the term of this patent is extended or adjusted under 35 U.S.C. 154(b) by 361 days.

(21) Appl. No.: 10/559,791

(22) PCT Filed: Jun. 7, 2004

(86) PCT No.: PCT/SE2004/000887

§ 371 (c)(1),
(2), (4) Date: Jan. 22, 2007

(87) PCT Pub. No.: WO2004/108044

PCT Pub. Date: Dec. 16, 2004

(65) Prior Publication Data

US 2007/0157389 A1 Jul. 12, 2007

(30) Foreign Application Priority Data

Jun. 10, 2003 (SE) ..... 0301678

(51) Int. Cl.
*A61G 1/00* (2006.01)

(52) U.S. Cl. ..... 5/625

(58) Field of Classification Search ..... 5/625, 5/626, 503.1, 505.1; 296/20
See application file for complete search history.

(56) References Cited

U.S. PATENT DOCUMENTS

| | | | | |
|---|---|---|---|---|
| 4,783,109 | A | 11/1988 | Bucalo | |
| 5,327,600 | A * | 7/1994 | Hoogendoorn | 5/625 |
| 5,497,968 | A | 3/1996 | Hewko | |
| 6,446,285 | B1 * | 9/2002 | Chinn | 5/507.1 |
| 7,376,992 | B2 * | 5/2008 | Salt et al. | 5/626 |
| 2003/0115671 | A1 * | 6/2003 | Smeed | 5/503.1 |
| 2003/0163871 | A1 * | 9/2003 | Conlu et al. | 5/503.1 |
| 2008/0047064 | A1 * | 2/2008 | Theran et al. | 5/503.1 |

FOREIGN PATENT DOCUMENTS

| | | |
|---|---|---|
| DE | 27 39 358 | 8/1978 |
| FR | 2 639 825 | 6/1990 |
| WO | 02/26185 | 4/2002 |

OTHER PUBLICATIONS

International Search Report for PCT/SE2004/000887 dated Sep. 17, 2004.

* cited by examiner

*Primary Examiner*—Jennifer H Gay
*Assistant Examiner*—Gilbert Y Lee
(74) *Attorney, Agent, or Firm*—Nixon & Vanderhye P.C.

(57) ABSTRACT

Mobile stretcher comprising a bed face on a frame provided with a head-end and a foot-end, the foot-end being provided with a fixedly arranged rack, which carries at least one medical instrument, the rack being formed so that the medical instrument carried by the rack is located midwise above the foot-end.

12 Claims, 1 Drawing Sheet

MOBILE STRETCHER

This application is the US national phase of international application PCT/SE2004/000887 filed 7 Jun. 2004, which designated the U.S. and claims priority to SE 0301678-9 filed 10 Jun. 2003, the entire contents of each of which are hereby incorporated by reference.

TECHNICAL FIELD OF THE INVENTION

The present invention relates to the area of mobile stretchers and especially to intensive-care stretchers that are adapted for a fixed placing of medical instruments such as suction units, patient monitor including defibrillator, ventilator/respirator units, oxygen unit as well as infusion pump in direct connection to the stretcher.

BACKGROUND OF THE INVENTION

A previously known mobile intensive-care stretcher is formed with an instrument placing under the stretcher with each instruments being manoeuvrable and readable from the side.

Another previously known mobile intensive-care stretcher is formed with an instrument placing at the head-end of the stretcher where also manoeuvring and monitoring takes place.

Such prior instrument placings do, on one hand, not act disturbing on medical actions since the instruments are located at a distance from the action area, but on the other hand, these placings represent difficulties upon certain actions by virtue of the distance from the action location. Thus, these instruments in these known stretchers may be difficult to quickly be able to monitor and manoeuvre during an action.

OBJECT OF THE INVENTION

The present invention aims at providing a mobile intensive-care stretcher having an improved medical instrument placing, an improved instrumental manageability and clearness at the same time as the instrument placing does not constitute an obstacle for moving a lying patient to and from the stretcher and which furthermore neither constitutes an obstacle for different types of medical actions.

SUMMARY OF THE INVENTION

By the present invention, such as the same appears the independent claim, the above-mentioned object is fulfilled. Suitable embodiments of the invention are defined in the dependent claims.

The invention relates to a mobile stretcher comprising a rack in the foot-end thereof, which rack carries mounting devices for medical instruments in such a way that the instruments will be placed centred midwise above the foot-end of the stretcher as well as enable space for a patient to lie under said instruments with his/her legs. Furthermore, the rack is so formed that no part of the rack constitutes an obstacle for handling the legs and feet of the patient upon movement and medical actions.

Furthermore, the rack is formed so that a patient in a lying position may be lifted up on the stretcher generally laterally in a stretched-out position without neither rack nor instrumentation blocking the same.

The rack is formed with two rear support legs, which are fixedly connected to the frame of the stretcher and having such strength that all instruments may be carried by these as well as with two front support legs, which are individually foldable in the backward direction but also individually lockable to the frame of the stretcher in a lowered position.

The rack is further formed so that the height between the bed face of the frame and the bottom side of an instrument is in the interval of 30-50 cm and is provided with a shelf on which instruments may be placed.

The rack is furthermore provided with crash bows, protective hoods or the like in order to protect each instrument upon a possible tipping of the stretcher.

Furthermore, the rack co-operates with a directly adapted to transparency specially adapted spineboard that is adapted to the stretcher for x-ray, CT scan and computer tomography and that is manufactured from a composite material in such a way that said spineboard may transversally while having a patient on the top laterally be inserted under the rack and be locked to the bed face of the frame. Furthermore, said spineboard is provided with a mattress, which also is fastened at the stretcher by means of, e.g., Velcro®. Furthermore, there are bands or belts in order to strap a patient to the stretcher.

Furthermore, the mobile stretcher is manufactured in carbon fibre material and high-tensile aluminium, which implies that a complete stretcher having chassis, spineboard, mattress, medical instruments, gas and electrics/electronics will weigh only approx. 70 kg.

BRIEF DESCRIPTION OF THE DRAWING

The invention will now be described closer by means of embodiment examples, reference being made to the accompanying drawings where.

DESCRIPTION OF THE INVENTION

Figure 1:
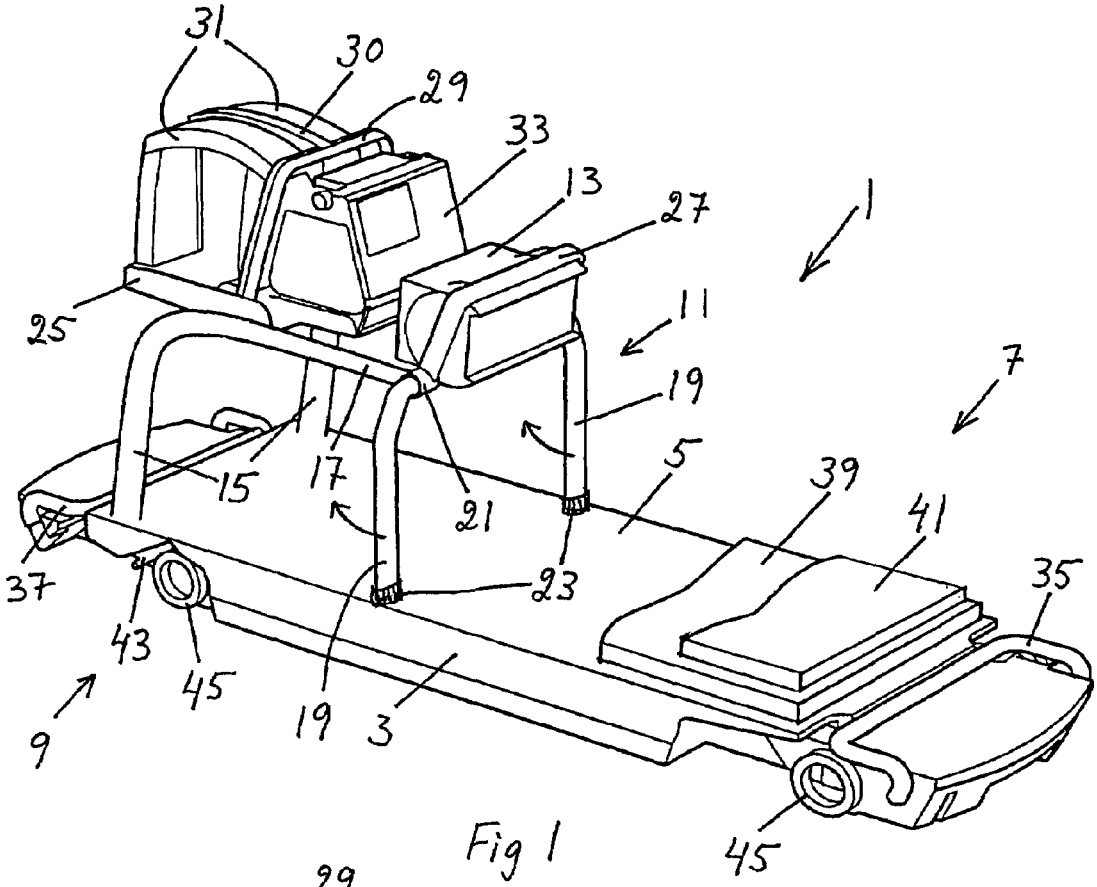
FIG. 1 shows a perspective view obliquely from above with the head-end closest, i.e. the front end, of an embodiment according to the present invention.

FIG. 1 shows a mobile stretcher 1, which comprises a frame 3 having a bed face 5. The frame is provided with a head-end 7 defined as the upper half of the stretcher and a foot-end 9 defined as the lower half of the stretcher. The foot-end is provided with a fixedly arranged rack 11 in order to carry at least one medical instrument 13, e.g., a ventilator/respirator such as Dräger's Oxylog 3000®. The rack is formed so that the medical instrument carried by the rack is located midwise above the foot-end, i.e. centred laterally above the foot-end, which is clearly seen in FIG. 2. The rack 11 is provided with two rear support legs 15 fixedly arranged on each side of the frame and leaning at an angle to the bed face of the frame for carrying the instrument 13. Each support leg 15 is provided with a support part 17 that is substantially parallel to the bed face 5 of the frame 3 and that extends forwards towards the head-end 7 of the stretcher. Furthermore, the front end of each support part is provided with a front support leg 19, which is arranged to supportingly abut at an angle to the bed face 5 of the frame 3. In one of the ends thereof, the front support legs 19 are individually turnably mounted in the front end 21 of the support part 17 in order to enable at least a turning backwards in the direction of the arrows of each support leg 19 to a position parallel to the bed face 5. In the other end thereof, the front support legs are provided with a locking device 23, which enables fixation of the support leg 19 at an angle in relation to the bed face 5 of the frame 3. By the phrase "at an angle", it is intended that each support leg extends from the bed face 5 upwards and at an angle inwards to the instruments in order to provide the best stability. Even if the figure shows the mounting of the support legs in the upper end and the locking in the lower end, the invention comprises embodiments having the mounting in the lower end of the support legs and the locking in the upper end. Also embodiments having the support legs insertable from the side for locking in both ends fall within the scope of the invention. The rack is further provided with a first transverse support member 25 in the form of a shelf against which the instrument is arranged to be supported and also fixed.

As is also seen in the figure, the rack is provided with a front crash bow 27, which surrounds the sides and the top. side of the medical instrument 13. Also a rear crash bow 29 is connected to the shelf in order to protect the instruments being carried by the shelf. From the middle of the rear crash bow 29, a longitudinal protective bow 30 runs. As an alternative to the shown crash bows, the instruments may be protected by one or more metal envelopes.

The instruments that are intended to be placed on the rack 11 are two suction units 31 in order to drain liquids, e.g. Laerdal™ Suction Unit (LSU). Furthermore, a patient monitor, in combination with a defibrillator 33, e.g. Zoll M-series CCT®, is placed on the rack 11. The patient monitor is formed in a way that enables a 30° deviating observation angle in relation to straight from the front. Also said ventilator/respirator is mounted on the rack. The suction units are easily detachable in order to be possible to be moved quickly, while the other instruments also are detachable but by means of tools. Furthermore, an infusion equipment, e.g. Alaris Medsystem III DLE®, is also included, which is fastened at the rack (not shown).

The head-end 7 of the frame is provided with front telescopic carrying handles 35 and the foot-end 9 of the frame is correspondingly provided with rear telescopic carrying handles 37. The figure shows the carrying handles telescoped.

The figure also schematically shows a specially adapted spineboard 39, which is screenable and provided with locking devices for fixation of the same to the bed face of the frame. Said spineboard manufactured from composite is further formed with a back that can be raised in a 15° position and a 30° position. The foot-end thereof may furthermore be raised in parallel approx. 12 cm in order to counteract a state of shock. On top of said spineboard, a mattress 41 lies, which also is fastened with said spineboard by means of Velcro®. Furthermore, the stretcher is provided with tightening belts in order to fix a patient (not shown).

Furthermore, the stretcher is provided with a locking shaft 43, which constitutes a part of a locking system for fixing the stretcher in an ambulance. At both the foot-end 9 and the head-end 7, combination wheels 45 are arranged, which wheels can be pulled out from the frame and may assume four positions, a first position with the wheels entirely retracted as the figure shows, the wheels being entirely inactive. A second position where the wheels are lowered 2 cm in order to be able to roll the stretcher on a substratum, a third position where the wheels are lowered 3-6 cm as well as a fourth position where the wheels are lowered 10-30 cm in order to roll the stretcher over thresholds etc.

Figure 2:
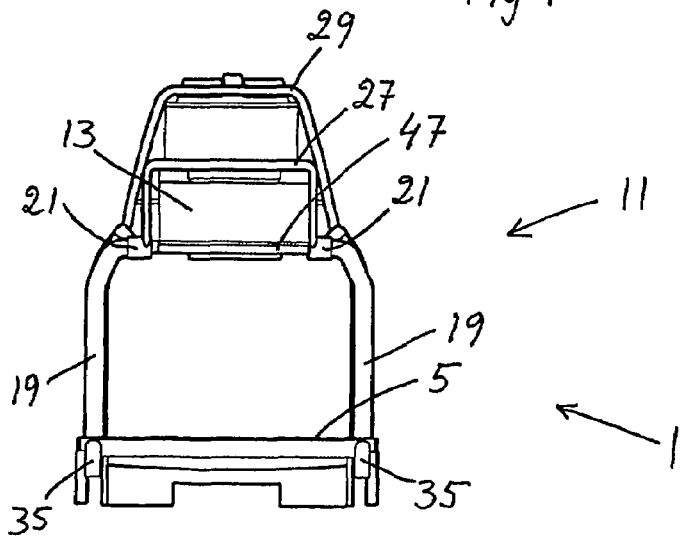
FIG. 2 shows a planar view seen from the head-end of the embodiment according to FIG. 1.

FIG. 2 shows the stretcher 1 straight from the front, the rack 11 being formed so that the bottom side of the medical instruments is located at a distance h above the bed face 5, where 30 cm $\leqq h \leqq 50$ cm. The figure also shows the front support legs 19 as well as the rear crash bow 29 and the front crash bow 27. Furthermore, it is seen in the figure that the instrument placing is situated midwise above the stretcher in a symmetrical way and that observation of the instrument 13, and other instruments, may be carried out without obstruction straight from the front. Also the front telescopic carrying handles 35 are shown in the figure. Between the front ends 21 of the support parts 17, a second transverse support member 47 is mounted, which on one hand supports said ends 21 and on the other hand the instrument 13.

Within the scope of the subsequent claims, a number of embodiments are feasible, which have not been shown here in detail but which easily may be realized with the aid of the description above.

The invention claimed is:

1. Mobile stretcher comprising a bed face on a frame provided with a head-end and a foot-end, the foot-end being provided with a fixedly arranged rack, which carries at least one medical instrument as well as that the rack is formed so that the medical instrument carried by the rack is located midwise above the foot-end, characterized in that the rack is arranged to co-operate with a spineboard transversally insertable under the rack as well as arranged to be locked to the bed face of the frame, each such support leg is provided with a support part that is substantially parallel to the bed face of the frame and that extends forwards towards the head-end of the stretcher, a front end of at least one support part is provided with a front support leg, which is arranged to supportingly abut leaningly towards the bed face of the frame, and the front support leg in one end thereof is turnably mounted in the front end of the support part or in the frame in order to at least enable a turning backwards to a position parallel to the bed face.

2. Mobile stretcher according to claim 1, characterized in that the front support leg in the other end thereof is provided with a locking device, which enables fixation of the support leg against the bed face of the frame.

3. A mobile stretcher comprising:

a frame comprised of a head-end and a foot-end, a bed face positioned on the frame, a rack that carries at least one medical instrument, the rack being mounted on the foot-end of the frame so that the medical instrument is located midway above the foot-end of the frame, a spineboard that can be placed on the bed face positioned on the frame, the rack being comprised of two rear support legs and two front support legs, each rear support leg being fixedly attached to a corresponding side of the frame and substantially leaning against the bed face on the frame to support without the front legs the medical instrument, and including a support part that is substantially parallel to the bed face of the frame so as to extend forward towards the head-end of the frame and position the medical instrument a predetermined distance above the bed face, each front support leg being individually lockable to the frame when in a lowered position and individually foldable in an upward and backward direction towards the foot-end of the frame, the front legs being foldable and the rear support legs being positioned on the frame so that no part of the rack or the medical instrumentation constitutes an obstacle to a patient's legs and feet who is lifted laterally onto the stretcher generally in a stretched-out position or to the spineboard when transversally inserted under the rack and onto the bed face of the frame.

4. The mobile stretcher of claim 3, wherein each of the front support legs is individually, turnably mounted in a front end of a corresponding support part to enable the front support leg to be foldable in the backward direction.

5. The mobile stretcher of claim 3, wherein a front end of each of the support parts is connected to a corresponding front support leg, which supportingly abuts the support part at an angle with respect to the bed face of the frame.

6. The mobile stretcher of claim 3, wherein each of the front support legs includes a locking device, which enables fixation of the support leg to the frame at an angle with respect to the bed face of the frame.

7. The mobile stretcher of claim 3, wherein the rack is provided with at least one transverse support member for supporting the support parts in a substantially parallel orientation and to which and by which the medical instrument is attached and supported, respectively.

8. The mobile stretcher of claim 3, wherein the rack includes at least one crash bow, which surrounds the medical instrument's sides and top.

9. The mobile stretcher of claim 3, wherein the rack includes front and rear crash bows, which surround the medical instrument's sides and top.

10. The mobile stretcher of claim 3, wherein the rack includes a shelf on which instruments may be carried.

11. The mobile stretcher of claim 10, wherein the rack includes a first crash bow that is connected laterally to the shelf to protect the instruments being carried by the shelf.

12. The mobile stretcher of claim 11, wherein the rack includes a second crash bow that is connected longitudinaly to the shelf to protect the instruments being carried by the shelf.

* * * * *